US010166550B2

(12) United States Patent
Tähkiö et al.

(10) Patent No.: US 10,166,550 B2
(45) Date of Patent: Jan. 1, 2019

(54) FLOTATION PLANT AND ITS USES, A METHOD OF CHANGING A FLOTATION TANK IN A TANK MODULE AND A METHOD OF CHANGING A MODULE

(71) Applicant: OUTOTEC (FINLAND) OY, Espoo (FI)

(72) Inventors: Pekka Tähkiö, Espoo (FI); Jukka Lakanen, Espoo (FI); Matti Luukkonen, Helsinki (FI)

(73) Assignee: OUTOTEC (FINLAND) OY, Espoo (FI)

( * ) Notice: Subject to any disclaimer, the term of this patent is extended or adjusted under 35 U.S.C. 154(b) by 0 days.

(21) Appl. No.: 15/571,908

(22) PCT Filed: May 13, 2015

(86) PCT No.: PCT/FI2015/050326

§ 371 (c)(1),
(2) Date: Jan. 3, 2018

(87) PCT Pub. No.: WO2016/181023

PCT Pub. Date: Nov. 17, 2016

(65) Prior Publication Data

US 2018/0161784 A1 Jun. 14, 2018

(51) Int. Cl.
*B03D 1/14* (2006.01)
*B03D 1/24* (2006.01)
(Continued)

(52) U.S. Cl.
CPC ..... *B03D 1/1406* (2013.01); *B03D 1/1462* (2013.01); *B03D 1/1487* (2013.01);
(Continued)

(58) Field of Classification Search
USPC ..... 209/164, 168–170
See application file for complete search history.

(56) References Cited

U.S. PATENT DOCUMENTS 1,457,077 A * 5/1923 Janney ..... B03D 1/16 209/168
2,142,010 A 12/1938 Sisson
(Continued)

FOREIGN PATENT DOCUMENTS

CN 101559407 A 10/2009
CN 201702028 U 1/2011
(Continued)

OTHER PUBLICATIONS

Santander, M. et al "Adsorbing colloidal flotation removing metals ions in modified jet cell", Minerals Engineering, Apr. 29, 2011, vol. 24, No. 9, pp. 1010-1015, doi:10.1016/j.mineng.2011.04.028, ISSN 0892-6875 abstract; p. 1012 chapter 2.3. Conventional Jameson cell.

(Continued)

*Primary Examiner* — Thomas M Lithgow
(74) *Attorney, Agent, or Firm* — Robert P. Michal, Esq.; Carter, DeLuca, Farrell & Schmidt, LLP

(57) ABSTRACT

A flotation plant includes a tank module which includes a self-supporting framework having an inner space. The tank module includes at least one flotation tank. The flotation tank is disposed in the inner space of the self-supporting framework. The tank module is a self-supporting unit capable of being transferable and hoistable as an integral entity. The flotation plant includes at least two drive units for the rotation of drive shafts, each drive shaft being connected to a rotor for mixing and/or forming bubbles in the flotation tank. An overflow receptacle is disposed at the level of the upper part of the tank module for receiving an overflow from the flotation tanks. The flotation plant includes an overflow channel which is connected to the overflow receptacle for receiving and conducting the overflow from the overflow
(Continued)

receptacle to a pumping means. The overflow channel is disposed outside the tank module.

15 Claims, 5 Drawing Sheets

(51) Int. Cl.
*B03D 1/20* (2006.01)
*B03D 1/02* (2006.01)

(52) U.S. Cl.
CPC ..... *B03D 1/20* (2013.01); *B03D 1/028* (2013.01); *B03D 1/14* (2013.01); *B03D 1/24* (2013.01)

(56) References Cited

U.S. PATENT DOCUMENTS 2,756,877 A * 7/1956 Sayers ..... B03D 1/18 209/168
2007/0114183 A1* 5/2007 Lee ..... B01D 17/0211 210/703

FOREIGN PATENT DOCUMENTS

EP 156699 A1 * 10/1985
EP 0156699 B1 2/1987
WO WO-2010/142844 A1 12/2010
WO WO-2012/047680 A2 4/2012

OTHER PUBLICATIONS

International Search Report issued by the Finnish Patent and Registration Office acting as the International Searching Authority in relation to International Patent Application No. PCT/FI2015/050326 dated Aug. 20, 2015 (5 pages).
Written Opinion of the International Searching Authority issued by the Finnish Patent and Registration Office acting as the International Searching Authority in relation to International Patent Application No. PCT/FI2015/050326 dated Aug. 20, 2015 (9 pages).
International Preliminary Report on Patentability issued by the Finnish Patent and Registration Office acting as the International Preliminary Examination Authority in relation to International Patent Application No. PCT/FI2015/050326 date completed Nov. 6, 2015 (6 pages).

* cited by examiner

FLOTATION PLANT AND ITS USES, A METHOD OF CHANGING A FLOTATION TANK IN A TANK MODULE AND A METHOD OF CHANGING A MODULE

FIELD OF THE INVENTION

The present invention relates to a flotation plant. Further, the invention relates to uses of the flotation plant. Further, the invention relates to method of changing a flotation tank in tank module. Further, the invention relates to a method of changing a module.

SUMMARY OF THE INVENTION

According to a first aspect, the present invention provides a flotation plant. The flotation plant comprises a tank module. The tank module includes a self-supporting framework having an inner space. The tank module includes at least one flotation tank. The flotation tank is disposed in the inner space of the self-supporting framework. The tank module is a self-supporting unit capable of being transferable and hoistable as an integral entity. The flotation plant comprises at least two drive units for the rotation of drive shafts, each drive shaft being connected to a rotor for mixing and forming bubbles in the flotation tank. The flotation plant comprises an overflow receptacle, the overflow receptacle being disposed at the level of the upper part of the tank module for receiving an overflow overflowing from the flotation tanks.

The flotation plant comprises an overflow channel connected to the overflow receptacle for receiving and conducting the overflow from the overflow receptacle to a pumping means. The overflow channel is disposed outside the tank module.

The flotation tank is a part that wears in use due to abrasive conditions inside the tank. Also crud may accumulate to the inner surface of the flotation tank. The technical effect of the invention is that since the overflow channel is outside the tank module and not inside the tank module, it does not obstruct or hinder maintenance, removal of the flotation tank from inside the tank module and/or installation of the flotation tanks into the tank module.

In this application the following definitions apply regarding flotation. Flotation involves phenomena related to the relative buoyancy of objects. The term flotation includes all flotation techniques. Flotation can be for example froth flotation, dissolved air flotation (DAF) or induced gas flotation. Froth flotation is a process for separating hydrophobic materials from hydrophilic materials by adding gas, for example air, to process. Froth flotation could be made based on natural hydrophilic/hydrophobic difference or based on hydrophilic/hydrophobic differences made by addition of a surfactant or collector chemical. Gas can be added to the feedstock subject of flotation (slurry or pulp) by a number of different ways. In one embodiment gas can be added to the stream of feedstock subject to flotation before it is fed to the flotation tank. In one embodiment gas can be added to feedstock subject to flotation in the flotation tank. In one embodiment gas adding equipment can include gas dispersing equipment at the bottom of the tank. In one embodiment gas adding equipment can include a feedstock (slurry or pulp) jet for jetting the feedstock to air. In one embodiment gas adding equipment includes a rotor inside the tank. In one embodiment gas can be added under the rotor. In one embodiment gas is added by a pipe ending under rotor. The pipe can be inside the flotation tank. The pipe can go through the bottom of the flotation tank. In one embodiment the rotor takes gas from the surface of sludge by vortex. In one embodiment gas is added by axis of the rotor. In one embodiment mixing equipment is arranged for mixing the slurry/pulp.

Mixing equipment could be for example a pump or a rotor. When the mixing is made by pump, the feedstock subject of flotation could be taken from one part of flotation tank and put back to another part of flotation tank. When mixing is made by the rotor, the rotor is inside the flotation tank. In one embodiment mixing equipment can include a rotor inside the flotation tank. In one embodiment mixing equipment can include a stator inside the flotation tank. The stator is for boosting mixing and to diffuse air to the feedstock (slurry or pulp) subject to flotation.

In one embodiment of the flotation plant, the overflow channel is connected to the overflow receptacle by a releasable joint. The technical effect is that the maintenance of the tank module and/or the overflow channel is made easy. The flotation tanks can be removed from and installed into the tank module when the joint is released.

In one embodiment of the flotation plant, the overflow channel comprises sloping channel portions. The sloping channel portions extend in a lengthwise direction of the tank module. The sloping channel portions being inclined at an angle in relation to horizontal direction. The technical effect of the overflow channel having sloping portions and the overflow channel being outside the tank module instead of being inside is that the sloping portions do not obstruct or hinder changing of the flotation tanks.

In one embodiment of the flotation plant, the overflow channel has a widthwise diameter of at least 250 mm. The technical effect is that this size class of the overflow channel ensures that the channel will not be clogged and the need for maintenance is minimized.

In one embodiment of the flotation plant, the widthwise diameter of the overflow channel is 250 to 1200 mm, preferably 400 mm to 1000 mm. The technical effect of the preferable diameter size class of 400 to 1000 mm is that when the flow rate is sufficient the overflow channel will be sufficiently washed out without a risk of clogging.

In one embodiment of the flotation plant, the overflow channel is supported by brackets to the self-supporting framework of the tank module. The technical effect is that manufacturing costs become low when the overflow channel is supported by the same framework as the flotation tank(s). The amount of frameworks in the flotation plant can be minimized.

In one embodiment of the flotation plant, the flotation plant comprises an accessory module. The accessory module includes a self-supporting framework having an inner space. The overflow channel is disposed in the inner space and supported by brackets to the self-supporting framework of the accessory module. The accessory module is a self-supporting unit capable of being transferable and hoistable as an integral entity. The accessory module is located on the side and next to the tank module. The technical effect is that if the overflow channel becomes clogged then it can be quickly changed by replacing the accessory module having the clogged overflow channel by another accessory module having an intact overflow channel, and the downtime becomes short.

In one embodiment of the flotation plant, the self-supporting framework of the tank module has a shape of a parallelepiped and comprises sidewalls. The overflow channel is connected to the overflow receptacle with a pipe. The pipe extends through the sidewall. The pipe has a releasable pipe joint.

In one embodiment of the flotation plant, the pipe is located at a height which is located within a range of 40% to 100% of the height of the tank module, wherein the total height of the tank module is 100%. The technical effect is that such a flow of the overflow in the overflow channel can be achieved that it sufficiently washes out the overflow channel so that clogging does not occur. Specifically, with a head of fall achieved by the above location of the pipe in combination with a sufficiently large diameter of the overflow channel it be achieved that no clogging occurs in the overflow channel.

In one embodiment of the flotation plant, the overflow channel comprises a chute.

In one embodiment of the flotation plant, the overflow channel comprises a pipeline. A closable pipeline is advantageous since the ends of the pipeline can be closed for the moment of transfer when the overflow channel needs maintenance. No liquid remained in the overflow channel will be leaked out during the transfer. This enhances work safety.

In one embodiment of the flotation plant, the self-supporting framework comprises a framework bottom and the framework sidewalls. The flotation tanks are self-supporting structures capable of being transferred and hoisted as an integral unit. The flotation tanks are placed inside the self-supporting framework without being attached to the framework bottom and the framework sidewalls. The self-supporting flotation tank has an integral monocoque structure that is able to hold its form while it is used, transferred and hoisted. The technical effect is that the flotation tank can easily be installed into the framework and also can easily be removed therefrom for maintenance or replacement since it is not attached to the framework.

In one embodiment of the flotation plant, the flotation tank is made of plastics.

In one embodiment of the flotation plant, the wall thickness of the flotation tank is 5-30 mm. The technical effect of the wall thickness within this range is that the tank will not be too heavy so that it can be changed easily but yet it is stiff enough so that it can be easily installed. The tapering of the tank at its upper part makes it stiff so that the tank is stiff despite the relatively thin wall.

In one embodiment of the flotation plant, the flotation tank is made of a thermoplastic polymer.

In one embodiment of the flotation plant, the thermoplastic polymer is polyethylene (PE) or polypropylene (PP). The technical effect of these materials is that they are very resistant to abrasive wear. Especially, when the tank is in use it may accommodate a rotating rotor for gas adding and/or mixing, the mixing of the feedstock subject of flotation by a rotor causes the feedstock (which can be very abrasive) to flow against inner surface of the tank wall and thereby causes severely abrasive wear conditions.

In one embodiment of the flotation plant, the thermoplastic polymer is polyethylene (PE).

In one embodiment of the flotation plant, the thermoplastic polymer is polypropylene (PP).

In one embodiment of the flotation plant, the flotation plant comprises one to six, preferably one to four, flotation tanks.

In one embodiment of the flotation plant, the flotation plant comprises at least two, preferably two to four, flotation tanks.

In one embodiment of the flotation plant, the flotation tanks are arranged in a row and in fluid communication with each other in the inner space of the self-supporting framework.

In one embodiment of the flotation plant, the volume of the flotation tank is 0.5-20 $m^3$, more preferably 1-15 $m^3$, most preferably 1-8 $m^3$. The technical effect is that the tanks can be changed easily as they are not too big and heavy. The tanks are still big enough so that a significant volume of capacity can be subjected to maintenance by changing a few tanks. The maintenance operations can be easily made for tanks which are not too big and heavy.

In one embodiment of the flotation plant, the flotation tank has a rectangular cross-sectional shape.

In one embodiment of the flotation plant, the flotation tank has a circular cross-sectional shape. The technical effect is that a cylindrical tank is inherently stiff. The stiffness enables easy handling, lifting and maintenance.

In one embodiment of the flotation plant, the flotation tank has a circular mouth. The technical effect of the circular mouth is that it stiffens the structure of the tank.

In one embodiment of the flotation plant, the flotation tank having a volume at most 8 $m^3$ is cylindrical. The technical effect is that the round form gives the required stiffness for the tank up to this size class.

In one embodiment of the flotation plant, the flotation tank having a volume greater than 8 $m^3$ has a rectangular or quadrangular cross-section. The technical effect is that such great tanks can be supported by sidewalls of the self-supporting framework in the inner space of which the tanks are installed in a tank module. The wall of the tank can be supported against the sidewall of the framework so that the framework bears loads exerted by the hydrostatic pressure of the liquid filled inside the tank.

In one embodiment of the flotation plant, the flotation tank having a rectangular or quadrangular cross-section comprises four tank sidewalls, and at least two of the tank sidewalls lean loosely against the framework sidewalls.

In one embodiment of the flotation plant, the overflow receptacle is disposed outside the tank module.

In one embodiment of the flotation plant, the overflow receptacle is disposed in the inner space of the self-supporting framework of the tank module.

In one embodiment of the flotation plant, flotation is froth flotation.

In one embodiment of the flotation plant, the flotation plant comprises gas adding equipment for adding gas to the feedstock subject of flotation.

In one embodiment of the flotation plant, the flotation plant comprises gas adding equipment for adding gas to the stream of the feedstock subject of flotation before entering the flotation tank.

In one embodiment of the flotation plant, the flotation plant comprises gas adding equipment for adding gas to the feedstock subject of flotation in the flotation tank.

In one embodiment of the flotation plant, the gas adding equipment includes a rotor inside the flotation tank.

In one embodiment of the flotation plant, the gas adding equipment includes a hollow rotatable drive shaft, and the rotor is connected to the drive shaft.

In one embodiment of the flotation plant, the feedstock subject of flotation is slurry or pulp.

In one embodiment of the flotation plant, the flotation plant comprises mixing equipment.

In one embodiment of the flotation plant, the mixing equipment includes a rotor inside the flotation tank.

In one embodiment of the flotation plant, the mixing equipment includes a stator inside the flotation tank.

In one embodiment of the flotation plant, the flotation tank having a bottom is disposed inside the framework, and the stator is connected to the framework through the bottom.

According to a second aspect of the invention, the invention provides use of the flotation plant according to the first aspect for separating material by flotation based on differences of buoyancy properties of substances. For example there is buoyancy difference when organic material is separated from aqueous material.

According to a third aspect, the present invention provides use of the flotation plant according to the first aspect of the invention for separating solid material by froth flotation based on differences of hydrophilic properties of substances. Solid materials separated by froth flotation could be oil sands, carbon, coal, talk, industrial minerals and mineral particles. The minerals may include industrial minerals and ore. Froth flotation to solid material could be made based on natural hydrophilic/hydrophobic difference or based on hydrophilic/hydrophobic differences made by addition of a surfactant or collector chemical or other chemical.

According to a fourth aspect, the present invention provides use of the flotation plant according to the first aspect of the invention for concentrating ore by froth flotation. An ore is a type of rock that contains sufficient minerals with important elements including metals that can be economically extracted from the rock. Metal ores are generally oxides, sulfides, silicates, or metals such as native copper or gold.

Froth flotation of ore could be made based on natural hydrophilic/hydrophobic difference or based on hydrophilic/hydrophobic differences made by addition of a surfactant or collector chemical or other chemical.

According to a fifth aspect, the present invention provides use of the flotation plant according to the first aspect of the invention for flotation of substances containing abrasive material. The abrasive mineral may be, for example, pyrite, silica, chromite.

The drive module being hoistable and transferable as one unit to gain access to the tanks enables that the tanks can easily be maintained or replaced when they are outworn and are at the end of their life. This is important especially with the use in connection with abrasive material. Use of the flotation plant which is easy to maintenance is effective when flotation is made to abrasive material.

According to a sixth aspect, the present invention provides use of the flotation plant according to the first aspect of the invention for froth flotation of ore containing pyrite, silica, chromite. Use of the tank module which is easy to maintenance and has preferably tanks made from PE or PP is effective when flotation is made to ore containing pyrite, silica, chromite. PE and PP are durable against the ore containing pyrite, silica, chromite.

According to a seventh aspect, the present invention provides a method of changing the flotation tank in the tank module of the flotation plant according to the first aspect of the invention, the method comprising steps of removing the flotation tank out from inside the framework, and installing another flotation tank into the framework.

In one embodiment of the method, in the installing step the flotation tank and the overflow receptacle attached to the flotation tank are installed as one integral entity.

In one embodiment of the method, the steps of removing and installing include a lifting step.

According to an eighth aspect, the present invention provides a method of changing of a module, wherein the method comprises changing of the tank module in the flotation plant according to the first aspect of the invention, in which method the tank module subject of maintenance is replaced by another tank module.

In one embodiment of the method, the accessory module containing the overflow channel is left immobile while the tank module is replaced.

In one embodiment of the method, the accessory module containing the overflow channel is replaced by another accessory module containing the overflow channel.

The embodiments of the invention described hereinbefore may be used in any combination with each other. Several of the embodiments may be combined together to form a further embodiment of the invention. An apparatus, a method, a composition or a use, to which the invention is related, may comprise at least one of the embodiments of the invention described hereinbefore

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings:

FIG. 3 is a schematic cross-section corresponding to FIG. 2 of a third embodiment of the flotation plant according to the invention.

DETAILED DESCRIPTION OF THE INVENTION

Although flotation is disclosed in the following examples by reference to froth flotation, it should be noted that the principles according to the invention can be implemented regardless of the specific type of the flotation, i.e. the flotation technique can be any of the known per se flotation techniques, such as froth flotation, dissolved air flotation or induced gas flotation.

Referring to FIGS. 1-5, they show a froth flotation plant that is configured for implementing froth flotation. In this embodiment the froth flotation plant has been assembled from self-supporting modules that together form a modular froth flotation plant. The modules from which the froth flotation plant has been built are removably stacked on top of each other to form a three-storeyed structure having a first storey I at the bottom, a second storey II in the middle and a top storey III. A tank module 1 located in the second storey II.

A tank module 1, which is located at the second storey II, includes a self-supporting framework 2 having an inner space 3. In the example shown in FIG. 1, the tank module 1 includes four froth flotation tanks 4 arranged in a row in the inner space 3 of the self-supporting framework 2 of the tank module 1. The flotation tanks 4 are arranged in a row and in fluid communication with each other so that an underflow can flow through the tanks. The number of the froth flotation tanks 4 within the tank module 1 is one to six, preferably one to four. The tank module 1 is a self-supporting unit capable of being transferable and hoistable as an integral entity.

Figure 2A:
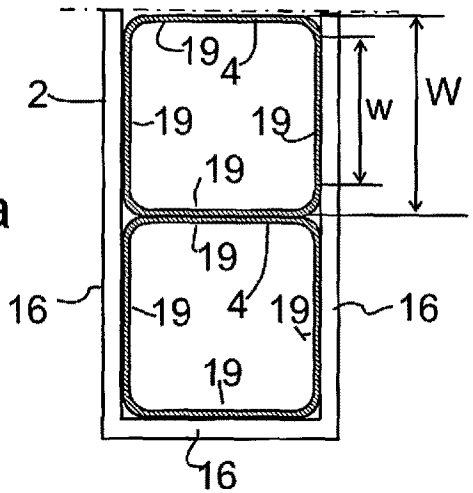
FIG. 2*a* is a cross-section IIa-IIa from FIG. 2.
Figure 2B:
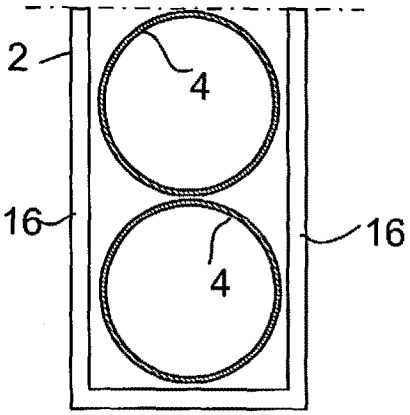
FIG. 2*b* is an alternative cross-section to that shown in FIG. 2*a*.
Figure 2:
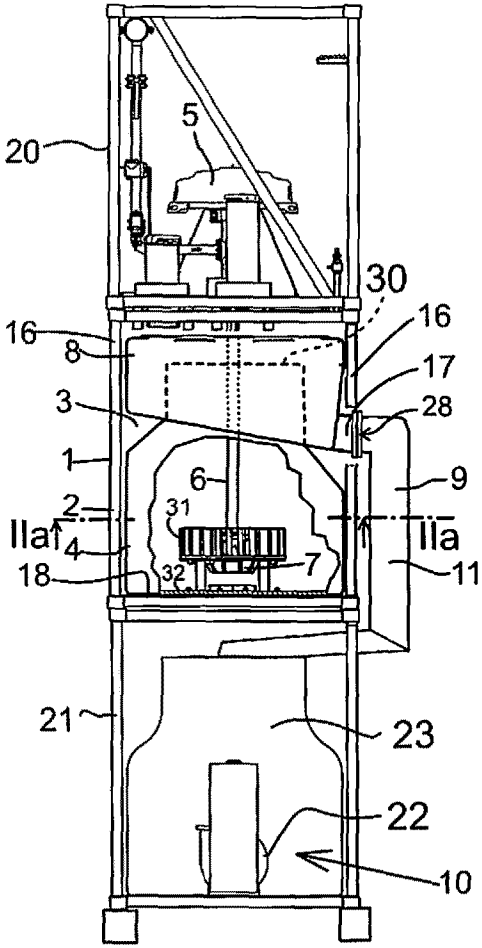
FIG. 2 is a schematic cross-section II-II from FIG. 1.

As shown in FIGS. 2, 2*a* and 2*b*, the self-supporting framework 2 comprises a framework bottom 18 and the framework sidewalls 16. The froth flotation tanks 4 are also self-supporting structures that can be transferred and hoisted as integral units. The froth flotation tanks 4 are placed inside the self-supporting framework 2 without being attached to the framework bottom 18 and the framework sidewalls 16.

One drive unit 5 for each froth flotation tank 4 is disposed to rotate a drive shaft 6. The drive shaft 6 is connected to a rotor 7 for mixing and forming bubbles in the froth flotation tank 4. The drive shaft 6 is hollow so that gas can be fed through it to the rotor 7 which disperses it to the feedstock subject of flotation in the flotation tank. A stator 31 is disposed to surround the rotor 7. The stator 31 is connected to the framework 2 through the bottom 32.

In the embodiments shown in FIGS. 1 to 5 the froth flotation plant includes a drive module 20 which is located at the third storey III so that the drive module 20 is removably stacked on top of the tank module 1. The drive module 20 includes four drive units 5 for the rotation of the drive shafts 6.

Figure 1:
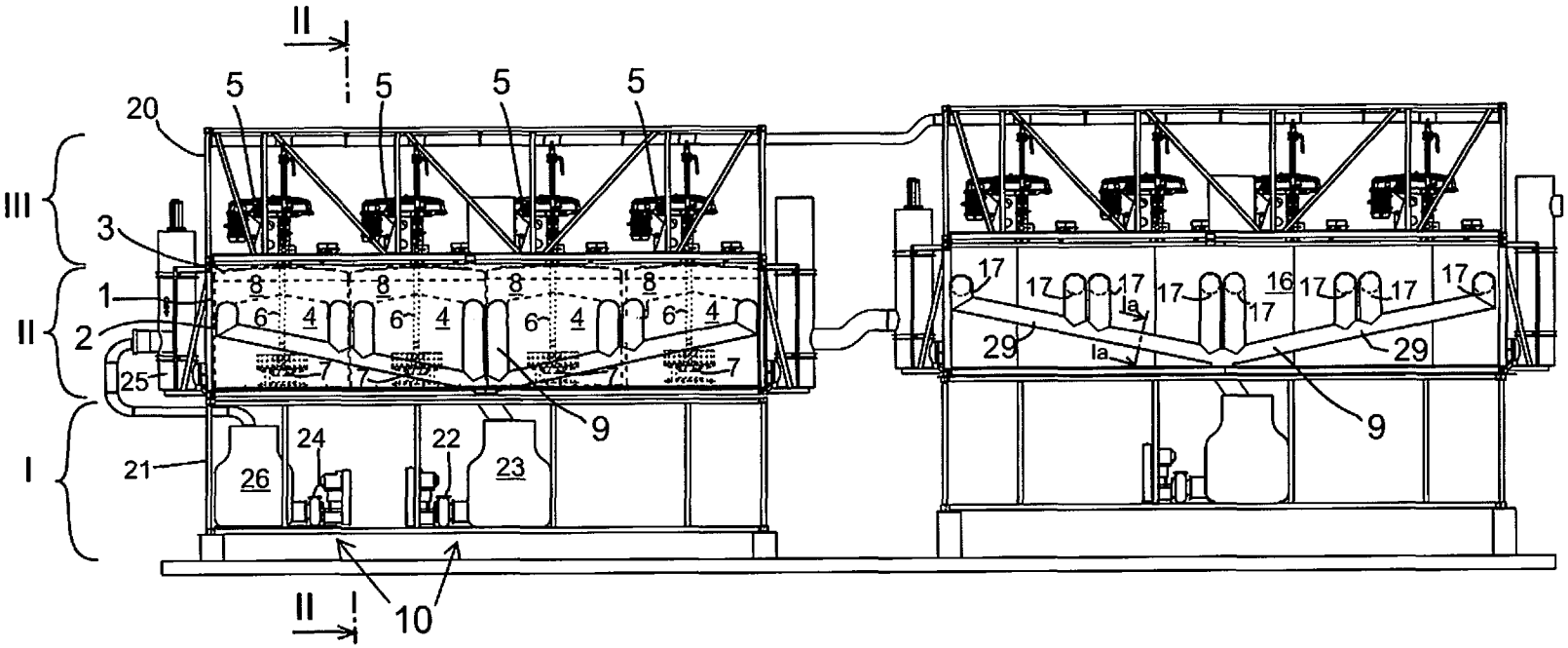
FIG. 1 is a schematic side view of a first embodiment of the flotation plant according to the invention.
Figure 3:
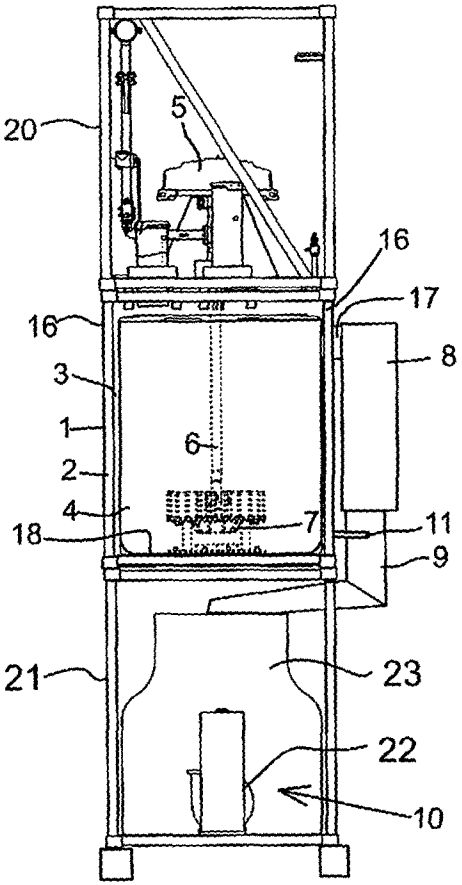
FIG. 3 is a schematic cross-section corresponding to FIG. 2 of a second embodiment of the flotation plant according to the invention.

In the examples shown in FIGS. 2 and 3, the stack formed of the tank module 1 and the drive module 20 is removably placed on top of a pump sump module 21 located at the first storey I of the froth flotation plant. Referring to FIG. 1, the pump sump module 21 includes a pumping means 10. The pumping means 10 may include a first pump 22 for pumping the overflow which comes via an overflow channel 9 to a first sump tank 23 wherefrom the settled overflow can be pumped away by the first pump 22 to further processing. As shown in FIG. 1, the pump sump module 21 may also include a second pump 24 for pumping the underflow which comes from the froth flotation tank 4 via a discharge box 25 to a second sump tank 26 wherefrom it can be pumped away by the second pump 24 to further processing.

Referring again to FIGS. 1-5, the froth flotation plant comprises one overflow receptacle 8 for each one of the froth flotation tanks 4 for receiving an overflow overflowing from the flotation tank 4. The overflow receptacles 8 are disposed at the level of the upper part of the tank module 1.

Figure 4:
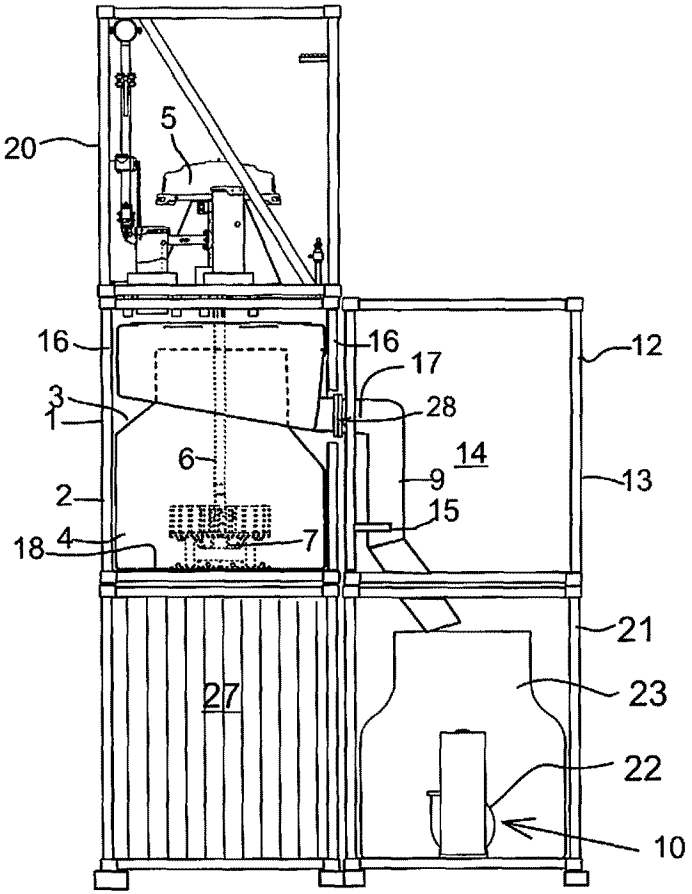
FIG. 4 is a schematic cross-section corresponding to FIG. 2 of a fourth embodiment of the flotation plant according to the invention

In the examples shown in FIGS. 2 and 4 the overflow receptacles 8 are inside the second self-supporting framework 2 of the tank module 1 and each overflow receptacle 8 is connected to the froth flotation tank 1 to be transferable and hoistable as an integral unit with the froth flotation tank. Preferably, the froth flotation tanks 1 are made of plastics, e.g. polypropylene or polyethylene. Preferably, the overflow receptacles 8 are made of the same material as the froth flotation tanks. The froth flotation tank 4 and the overflow flow receptacle 8 are connected to each other by welding.

Figure 5:
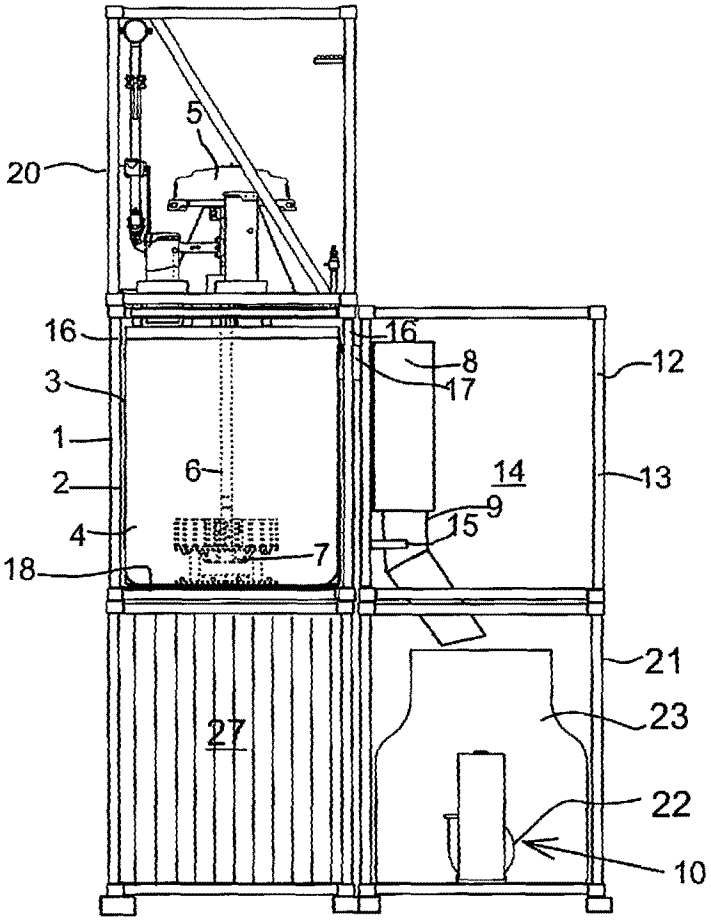
FIG. 5 is a schematic cross-section corresponding to FIG. 2 of a fifth embodiment of the flotation plant according to the invention

In the examples shown in FIGS. 3 and 5 the overflow receptacle 8 is disposed outside the tank module 1 on one side of the tank module. In these examples the froth flotation plant comprises an accessory module 12. The accessory module 12 is a self-supporting unit capable of being transferable and hoistable as an integral entity 1. The accessory module 12 is placed on on one side and next to the tank module 1 at the level of the second storey II. The accessory module 12 includes a self-supporting framework 13 having an inner space 14. The overflow receptacle 8 is arranged in an inner space 14 of the accessory module 12. The overflow receptacle 8 is supported by brackets to a self-supporting framework 13 of the accessory module 12.

In the examples shown in FIGS. 3 and 5 the accessory module 12 is removably placed on top of the pump sump module 21. The tank module 1 and the drive module 20 are removably placed on top of a foundation module 27 located at the first storey I.

With reference to FIGS. 1-5, an overflow channel 9 is connected in fluid communication with the overflow receptacles 8 for receiving and conducting the overflow from the overflow receptacle 8 to the pumping means 10. The overflow channel 9 is connected to the overflow receptacles 8 by releasable joints 28. The overflow channel 9 is disposed outside the tank module 1.

In the examples shown in FIGS. 2 and 3 the overflow channel 9 is supported by brackets 11 to the self-supporting framework 2 of the tank module 1.

In the examples shown in FIGS. 4 and 5 the overflow channel 9 is disposed in the inner space 14 of the self-supporting framework 13 of the accessory module 12. The overflow channel is supported by brackets 15 to the self-supporting framework 13 of the accessory module 12.

The overflow channel 9 is connected to the overflow receptacle 8 with a pipe 17, the pipe extending through the side wall 16. The pipe 17 is located at a height which is located within a range of 40% to 100% of the height of the tank module 1, wherein the total height of the tank module is 100%.

Figure 1A:
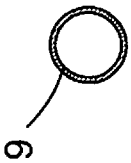
FIG. 1*a* is a cross-section Ia-Ia from FIG. 1.
Figure 1B:
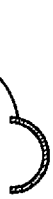
FIG. 1*b* is an alternative cross-section to that shown in FIG. 1*a*.

FIG. 1*a* shows that the overflow channel 9 may comprise a pipeline having a closed shape of cross-section. FIG. 1*b* illustrates an alternative wherein the overflow channel 9 may comprise a chute having an open shape of the cross-section. Preferably, in order to ensure continuous flowing of the overflow and to avoid clogging of the overflow channel 9 it has a widthwise diameter of at least 250 mm. More preferably the widthwise diameter of the overflow channel 9 is 250 to 1200 mm. Most preferably the widthwise diameter of the overflow channel 9 is 400 mm to 1000 mm.

As mentioned, the froth flotation tanks 4 are self-supporting structures that can be transferred and hoisted as integral units. The froth flotation tank 5 is made of a thermoplastic polymer, e.g. polyethylene PE or polypropylene PP which is very resistant to abrasion. The wall thickness of the self-supporting tank 5 is 5-30 mm. The volume of the froth flotation tank 4 is 0.5-20 $m^3$, more preferably 1-15 $m^3$, most preferably 1-8 $m^3$.

As shown in FIG. 2*b* the self-supporting froth flotation tank 4 may be cylindrical whereby it has a circular cross-section. Preferably, the froth flotation tank 4 is cylindrical when the volume of the froth flotation tank is at most 8 $m^3$.

Preferably, the flotation tank 4 has a circular mouth 30. A circular mouth 30 gives stiffness for the whole structure of the flotation tank 4.

FIG. 2*a* illustrates that the froth flotation tank 4 that has a volume greater than 8 $m^3$ preferably has a rectangular or quadrangular cross-section. The froth flotation tank 4 having a rectangular or quadrangular cross-section comprises four tank sidewalls 19. At least two of the tank sidewalls 19 lean against the framework sidewalls 16 whereby the framework sidewalls 16 may support the tank sidewalls against the hydrostatic pressure. The tank sidewalls 19 comprise a planar wall part. The planar wall part has a width w which is at least 70% of the total width W of the tank sidewall. At least two of the planar parts of the tank sidewalls lean against the framework sidewalls 16.

It is obvious to a person skilled in the art that with the advancement of technology, the basic idea of the invention may be implemented in various ways. The invention and its embodiments are thus not limited to the examples described above, instead they may vary within the scope of the claims.

The invention claimed is:

1. A flotation plant, comprising:

tank module including a self-supporting framework having an inner space, a framework bottom and framework sidewalls, the tank module including at least two flotation tanks, the at least two flotation tanks being disposed in the inner space of the self-supporting framework, the at least two flotation tanks being self-supporting structures capable of being transferred and hoisted as integral units, and the flotation tanks are placed inside the self-supporting framework without being attached to the framework bottom and the framework sidewalls, and the tank module being a self-supporting unit capable of being transferable and hoistable as an integral entity;

at least two drive units for the rotation of drive shafts, each drive shaft being connected to a rotor for mixing and/or forming bubbles in the flotation tank;

an overflow receptacle being disposed at the level of the upper part of the tank module for receiving an overflow from the flotation tanks; and an overflow channel connected to the overflow receptacle for receiving and conducting the overflow from the overflow receptacle to a pump, and the overflow channel is disposed outside the tank module.

2. The flotation plant according to claim 1, wherein the overflow channel is connected to the overflow receptacle by a releasable joint.

3. The flotation plant according to claim 1, wherein the overflow channel comprises sloping channel portions, the sloping channel portions extending in a lengthwise direction of the tank module, the sloping channel portions being inclined in relation to horizontal direction.

4. The flotation plant according to claim 1, wherein the overflow channel has a widthwise diameter of at least 250 mm.

5. The flotation plant according to claim 4, wherein the widthwise diameter of the overflow channel is 250 to 1200 mm, preferably 400 mm to 1000 mm.

6. The flotation plant according to claim 1, wherein the overflow channel is supported by brackets to the self-supporting framework of the tank module.

7. The flotation plant according to claim 1, wherein the flotation plant comprises an accessory module, the accessory module including a self-supporting framework having an inner space, the overflow channel being disposed in the inner space and supported by brackets to the self-supporting framework of the accessory module, the accessory module being a self-supporting unit capable of being transferable and hoistable as an integral entity, the accessory module being located on the side and next to the tank module.

8. The flotation plant according to claim 1, wherein the self-supporting framework of the tank module has a shape of a parallelepiped and comprises vertical side walls, and the overflow channel is connected to the overflow receptacle with a pipe, the pipe extending through the side wall.

9. The flotation plant according to claim 8, wherein the pipe is located at a height which is located within a range of 40% to 100% of the height of the tank module, wherein the total height of the tank module is 100%.

10. The flotation plant according to claim 1, wherein the overflow channel comprises a chute.

11. The flotation plant according to claim 1, wherein the overflow channel comprises a pipeline.

12. The flotation plant according to claim 1, wherein the flotation tank comprises plastic.

13. A method of operating the flotation plant, comprising:

providing a flotation plant according to claim 1; and separating material by flotation based on differences of buoyancy properties of substances, or separating solid material by froth flotation based on differences of hydrophilic properties of substances, or concentrating ore by froth flotation, or flotation of substances containing abrasive material, or froth flotation of ore containing pyrite, silica, or chromite.

14. A method of changing the flotation tank in the tank module of the flotation plant according to claim 1, wherein the method comprises steps of:

providing the flotation plant of claim 1, removing the flotation tank out from inside the framework, and installing another flotation tank into the framework.

15. A method of changing a tank module comprising providing a flotation plant according to claim 1, in which method the tank module subject of maintenance is replaced by another tank module and removing the tank module for maintenance and replacing the removed tank module with another tank module.

* * * * *